US006616431B2

(12) United States Patent
Kitano et al.

(10) Patent No.: US 6,616,431 B2
(45) Date of Patent: Sep. 9, 2003

(54) SCROLL-TYPE COMPRESSORS

(75) Inventors: Norio Kitano, Isesaki (JP); Yasuomi Matsumoto, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 10/060,141

(22) Filed: Feb. 1, 2002

(65) Prior Publication Data

US 2002/0119064 A1 Aug. 29, 2002

(30) Foreign Application Priority Data

Feb. 28, 2001 (JP) ..... P2001-054711

(51) Int. Cl.[7] ..... F01C 1/02
(52) U.S. Cl. ..... 418/55.6; 418/87
(58) Field of Search ..... 418/55.6, 87, 84

(56) References Cited

U.S. PATENT DOCUMENTS

| | | | | |
|---|---|---|---|---|
| 4,314,796 A | | 2/1982 | Terauchi | |
| 4,340,339 A | | 7/1982 | Hiraga et al. | |
| 4,527,963 A | | 7/1985 | Terauchi | |
| 4,538,975 A | | 9/1985 | Tsukagoshi | |
| 4,547,138 A | | 10/1985 | Mabe et al. | |
| 4,561,832 A | | 12/1985 | Shimizu | |
| 4,596,520 A | * | 6/1986 | Arata et al. | 418/55.5 |
| 4,669,962 A | * | 6/1987 | Mizuno et al. | 418/55.5 |
| 4,932,845 A | | 6/1990 | Kikuchi et al. | |
| 4,936,756 A | | 6/1990 | Shimizu et al. | |
| 5,000,669 A | | 3/1991 | Shimizu et al. | |
| 5,330,335 A | | 7/1994 | Teracuhi et al. | |
| 5,431,550 A | | 7/1995 | Otake | |
| 5,888,057 A | | 3/1999 | Kitano et al. | |
| 6,276,910 B1 | | 8/2001 | Tsukamoto | |

FOREIGN PATENT DOCUMENTS

| | | | | |
|---|---|---|---|---|
| JP | 58124083 A | * | 7/1983 | F04C/18/02 |
| JP | 58160580 A | * | 9/1983 | F04C/18/02 |
| JP | 07035081 A | * | 2/1995 | F04C/29/10 |
| JP | 8177762 | | 7/1996 | |
| JP | 2000337273 A | * | 12/2000 | F04C/18/02 |

* cited by examiner

*Primary Examiner*—Thomas Denion
*Assistant Examiner*—Theresa Trieu

(57) ABSTRACT

A scroll-type compressor has a piston valve mechanism for controlling the feeding of lubricating oil to slidable parts of the compressor. The piston valve mechanism includes a cylinder bore that connects a medium pressure chamber and a low pressure chamber, and a piston valve and a spring accommodated with the cylinder bore. The spring resiliently biases the piston valve toward the medium pressure chamber. The piston valve is driven by a pressure difference between the medium pressure chamber and the low pressure chamber, and by the spring. In one embodiment, an inwardly stepped, narrowed portion formed in the cylinder bore engages the piston valve to prevent further compression of the spring.

7 Claims, 7 Drawing Sheets

SCROLL-TYPE COMPRESSORS

BACKGROUND OF THE INVENTION

1. Field of the Invention

The present invention relates to scroll-type compressors for use in air conditioning systems. More particularly, this invention relates to scroll-type compressors with improved piston valve mechanisms for controlling circulation of lubricating oil in such compressors.

2. Description of Related Art

Known scroll-type compressors generally have a structure in which a refrigerant, which flows through a refrigeration circuit, is drawn into a suction chamber of the scroll-type compressor. From the suction chamber, the refrigerant is drawn into a compression chamber formed by two scroll elements that cooperate to compress the refrigerant and then to discharge the compressed refrigerant into a discharge chamber. The compressor includes a plurality of slidable parts, e.g., bearing members.

The slidable parts may be lubricated by oil that circulates in the compressor. A portion of the oil accumulates in a liquid state within the compressor, while another portion of the oil exists in a suspended state, e.g., as a mist, and flows with the refrigerant through the compressor. If the accumulated liquid state oil (hereinafter referred to as "lubricating oil") is supplied to the slidable parts at an appropriate rate, the slidable parts will be lubricated.

For example, in Japanese Patent Publication Hei 8-177762, a scroll-type compressor is disclosed in which the internal space of the compressor includes a high pressure chamber, a medium pressure chamber, and a low pressure chamber. The pressure differences between these chambers are used to feed lubricating oil to the slidable parts of the compressor. The scroll-type compressor is equipped with a piston valve mechanism for controlling the flow of lubricating oil to the slidable parts. The piston valve mechanism includes a piston valve, which is slidably disposed in a cylinder bore. One end of the cylinder bore is in fluid communication with the low pressure chamber. The other end of the cylinder bore is in fluid communication with the medium pressure chamber. A spring, which is disposed at the low pressure side of the cylinder bore, engages the piston valve and biases it toward a snap ring, which is disposed at the medium pressure side of the cylinder bore. In this way, the refrigerant in the low pressure chamber and the resilient spring urge the piston valve toward the medium pressure chamber, while the refrigerant in the medium pressure chamber urges the piston valve toward the low pressure chamber. The movement of the piston valve opens and closes an oil passage that connects the high pressure chamber to the medium pressure chamber.

The compressor includes slidable parts disposed between the medium pressure chamber and the low pressure chamber. These slidable parts may be lubricated in the following manner. Lubricating oil that is in a suspended state in the suction chamber is drawn into the compression chamber with refrigerant from the refrigeration circuit. The lubricating oil flows through the compression chamber with the refrigerant and then is discharged to the high pressure chamber. A portion of the lubricating oil may accumulate in a liquid state in the high pressure chamber. When the piston valve is positioned to open the oil passage and place the high pressure chamber in fluid communication with the medium pressure chamber, the lubricating oil in the high pressure chamber may flow to the medium pressure chamber via the oil passage due to the pressure difference between the chambers. Subsequently, due to the pressure difference between the medium pressure chamber and the low pressure chamber, the lubricating oil may flow from the medium pressure chamber to the low pressure chamber, thereby lubricating the various slidable parts disposed between the medium chamber and the low pressure chamber.

In known scroll-type compressors, when the pressure difference between the medium pressure chamber and the low pressure chamber is too great, the piston valve may be displaced to such an extent and for such a duration that the spring may be overcompressed, e.g., compressed so that the coils are in contact. If overcompression of the spring occurs repeatedly, the spring may be damaged, e.g., it may lose its elasticity, it may deform, it may break, or the like. If the spring is damaged, the piston valve may not be displaced enough to open the oil passage. As a result, lubrication of the slidable parts may not occur or may be insufficient to prevent damage to the slidable parts.

SUMMARY OF THE INVENTION

A need has arisen for scroll-type compressors, in which a piston valve mechanism is driven by a pressure differential and a spring, for an improved mechanism that prevents overcompression of the spring.

In an embodiment of the present invention, a scroll-type compressor, which comprises a piston valve mechanism for controlling a flow of lubricating oil within the compressor, comprises a cylinder bore for establishing fluid communication between a medium pressure chamber and a low pressure chamber, and a piston valve and a spring accommodated within the cylinder bore. Moreover, the piston valve is driven by a pressure difference between the medium pressure chamber and the low pressure chamber, and by a spring that biases the piston valve toward the medium pressure chamber. Further, a stroke limiting mechanism limits movement of the piston valve against the spring.

In another embodiment of the present invention, the stroke limiting mechanism comprises an inwardly stepped, limiting portion formed in the cylinder bore for engaging an end surface of the piston valve.

In still another embodiment of the present invention, the stroke limiting mechanism comprises an outwardly stepped flange formed on the piston valve for engaging a shoulder formed in the cylinder bore.

In yet another embodiment of the present invention, the stroke limiting mechanism comprises a penetrating hole bored through the piston valve and a pin fixed to the compressor housing and inserted through the penetrating hole. Movement of the piston valve is limited by engagement of the pin and an inner wall of the penetrating hole.

In yet a further embodiment of the present invention, the stroke limiting mechanism comprises a rod formed on an end of the piston valve and inserted into the spring. Movement of the piston valve is limited by engagement of the rod and a stopping portion formed at an end of the cylinder bore.

In a still further embodiment of the present invention, the stroke limiting mechanism comprises a relief passage for providing fluid communication between the medium pressure chamber and the low pressure chamber. The piston valve opens the relief passage to reduce a pressure differential between the medium pressure chamber and the low pressure chamber to limit further movement of the piston valve against the spring.

In yet a further embodiment of the present invention, the stroke limiting mechanism comprises a relief passage that provides fluid communication between the medium pressure chamber and the low pressure chamber and a valve mechanism that opens the relief passage when a pressure differential between the medium pressure chamber and the low pressure chamber exceeds a desired level to limit further movement of the piston valve against the spring.

Other objects, features, and advantages of this invention will be apparent to, and understood by, persons of ordinary skill in the art from the following description of preferred embodiments with reference to the accompanying drawings.

BRIEF DESCRIPTION OF DRAWINGS

The present invention may be more readily understood with reference to the following drawings.

DETAILED DESCRIPTION OF PREFERRED EMBODIMENTS

Figure 1:
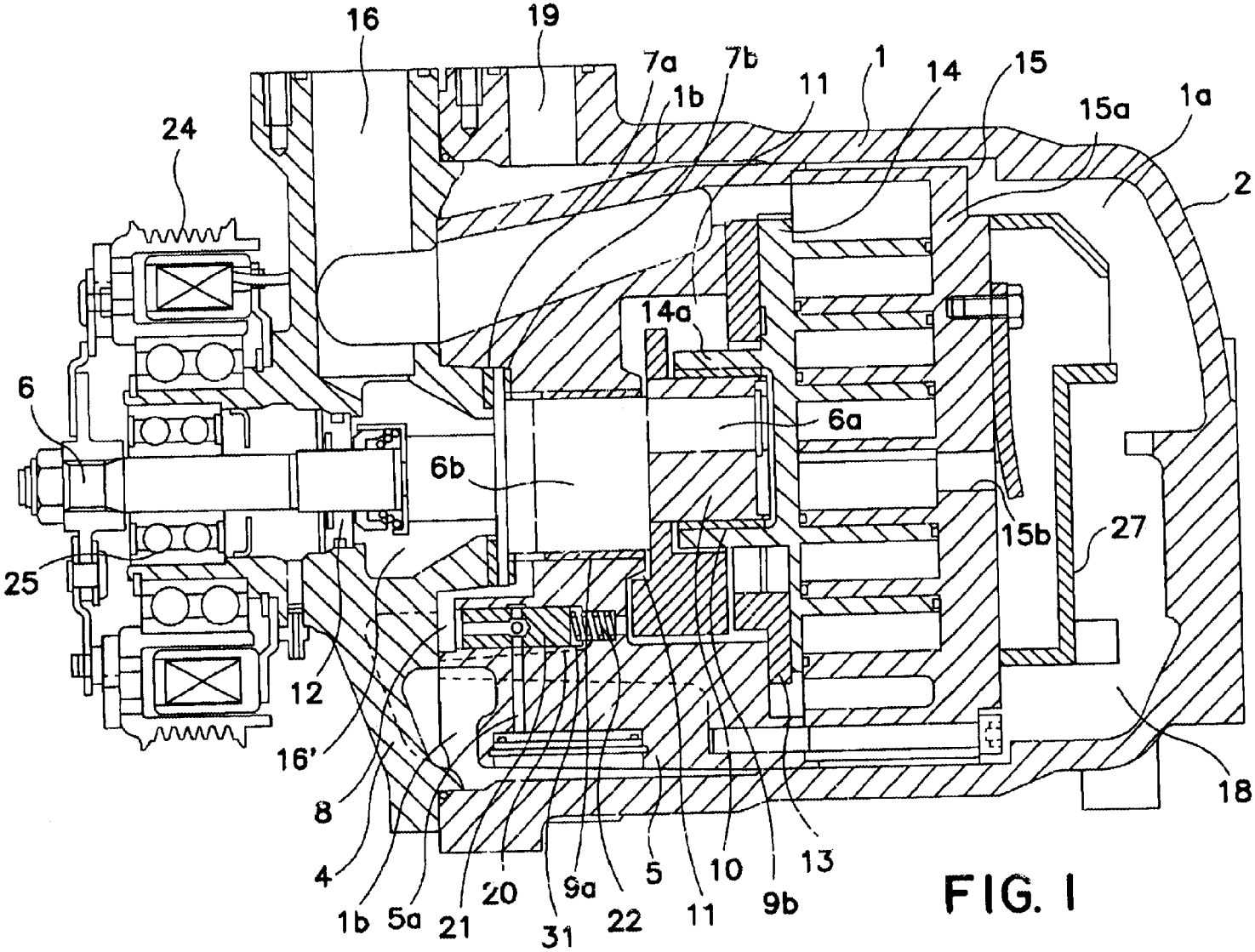
FIG. 1 is a cross-sectional view of a scroll-type compressor according to the first embodiment of the present invention.

With reference to FIG. 1, a scroll-type compressor comprises an outer shell 1, a front housing 4 which covers an open end of the shell 1, and a compressor accommodated within the shell 1.

The compressor comprises a main housing 5 which is enclosed between the shell 1 and the front housing 4, a drive shaft 6 which penetrates through the front housing 4 and the main housing 5, an orbiting scroll 14 that is connected to the drive shaft 6, and a fixed scroll 15 which is interfitted with the orbiting scroll 14. An Oldham ring 13 is disposed between the orbiting scroll 14 and the main housing 5 to prevent rotation of the orbiting scroll 14.

Orbiting scroll 14 interfits with the fixed scroll 15 and moves in an orbiting motion. In cooperation with the fixed scroll 15, the orbiting scroll 14 draws refrigerant through a suction port 16, which is formed through an upper portion of the front housing 4, and compresses the refrigerant by its orbiting motion relative to the fixed scroll 15. A discharge hole 15*b* is formed through a plate portion 15*a* of the fixed scroll 15 to enable the compressed refrigerant to be discharged from the compressor to a first high pressure chamber 1*a*.

First high pressure chamber 1*a* is formed as a high pressure space between the fixed scroll 15 and a bottom wall 2 of the shell 1. A second high pressure chamber 1*b* is formed as a high pressure space between the main housing 5, the shell 1, and the front housing 4. First high pressure chamber 1*a* and second high pressure chamber 1*b* are in fluid communication via passages (not shown) formed in the main housing 5 and fixed scroll 15. Moreover, the lower portion of first high pressure chamber 1*a* includes an oil sump 18 for accumulating the lubricating oil. A discharge port 19, which is formed through an upper portion of the shell 1, is in fluid communication with second high pressure chamber 1*b*, thereby enabling the discharge of refrigerant from the second high pressure chamber 1*b* to the refrigeration circuit (not shown).

The drive shaft 6 is mounted rotatably to the front housing 4 and the main housing 5. One end of the drive shaft 6 is supported rotatably on a protruding portion of the front housing 4 via ball bearing 25. Moreover, a driving mechanism 24 is disposed at this end of the drive shaft 6 for driving the drive shaft 6. A large diameter portion 6*b* is formed on the other end of the drive shaft 6. The large diameter portion 6*b* is supported rotatably on the main housing via a first radial bearing 9*a* which is disposed around the large diameter portion 6*b* of the drive shaft 6. The drive shaft 6 is supported rotatably in the axial direction via thrust bearings 7*a* and 7*b*.

A crank pin 6*a* extends from the large diameter portion 6*b* of the drive shaft 6 toward the orbiting scroll 14. Moreover, the crank pin 6*a* of the drive shaft 6 is displaced from, and orbits around, the longitudinal axis of the drive shaft 6. The crank pin 6*a* is connected rotatably to the orbiting scroll 14 in the following manner. An eccentric bushing 10 is mounted rotatably, via a second radial bearing 9*b*, in a cavity 14*a* extending from a plate of the orbiting scroll 14. The crank pin 6*a* is inserted in a hole in the eccentric bushing 10.

A low pressure chamber 11 is formed between an inner surface of the main housing 5 and the cavity 14*a* of the orbiting scroll 14. Another low pressure chamber 16' is formed between an inner surface of the front housing 4 and the drive shaft 6. The low pressure chamber 16' is in fluid communication with the suction port 16. Moreover, a shaft seal 12 is disposed between the drive shaft 6 and the front housing 4 to seal the low pressure chamber 16' from the external environment of the compressor.

In operation, the driving mechanism 24 rotates the drive shaft 6 about its longitudinal axis, thereby causing the orbiting scroll 14 to undergo an orbiting motion relative to the fixed scroll 15. Refrigerant is drawn from an external refrigeration circuit (not shown) through the suction port 16 into a space formed between the orbiting scroll 14 and the fixed scroll 15. Moreover, a portion of the lubricating oil that exists in a suspended state, e.g., as a mist, flows with the refrigerant into the compressor. The lubricating oil flows with the refrigerant as the refrigerant is compressed by the cooperating action of the orbiting scroll 14 and the fixed scroll 15. The lubricating oil and compressed refrigerant are discharged through a discharge hole 15*b*, which is formed through the plate portion 15*a* of the fixed scroll 15. A discharge valve 26 is attached to the plate portion 15*a* of the fixed scroll 15. The discharge valve 26 regulates the flow of the refrigerant and lubricating oil through the discharge hole 15*b* in the fixed scroll 15, into the first high pressure chamber 1*a*. Moreover, a baffle 27, which is fixed to the plate portion 15*a* of the fixed scroll 15, serves to separate the discharged lubricating oil from the compressed refrigerant, so that the lubricating oil may accumulate in the oil sump 18.

The compressed refrigerant travels from the first high pressure chamber 1*a,* via passages (not shown) formed in the fixed scroll 15 and the main housing 5, to the second high pressure chamber 1*b* and then, via the discharge port 19, to the external refrigeration circuit (not shown).

Figure 2A:
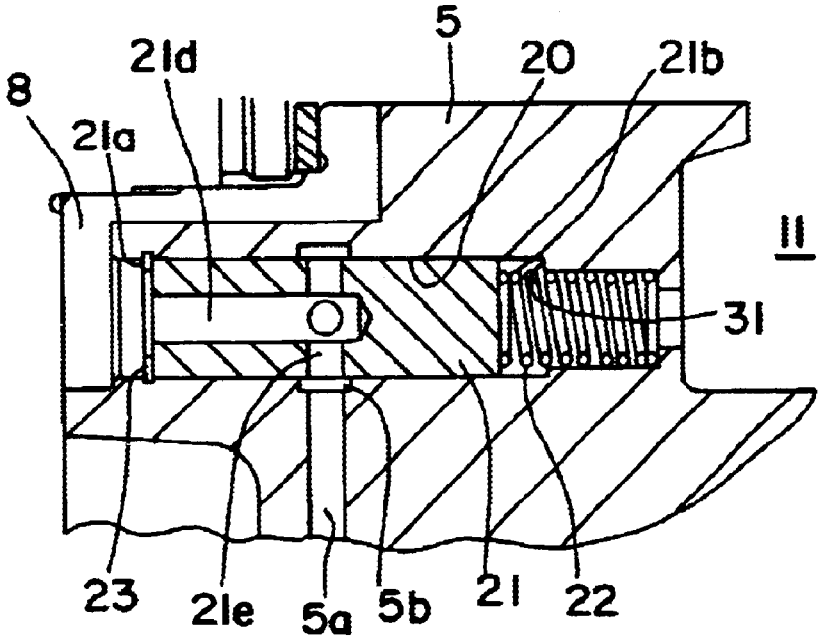
FIG. 2(*a*) and FIG. 2(*b*) show magnified cross-sectional views of the piston valve mechanism of FIG. 1, at different stages of compression.
Figure 2B:
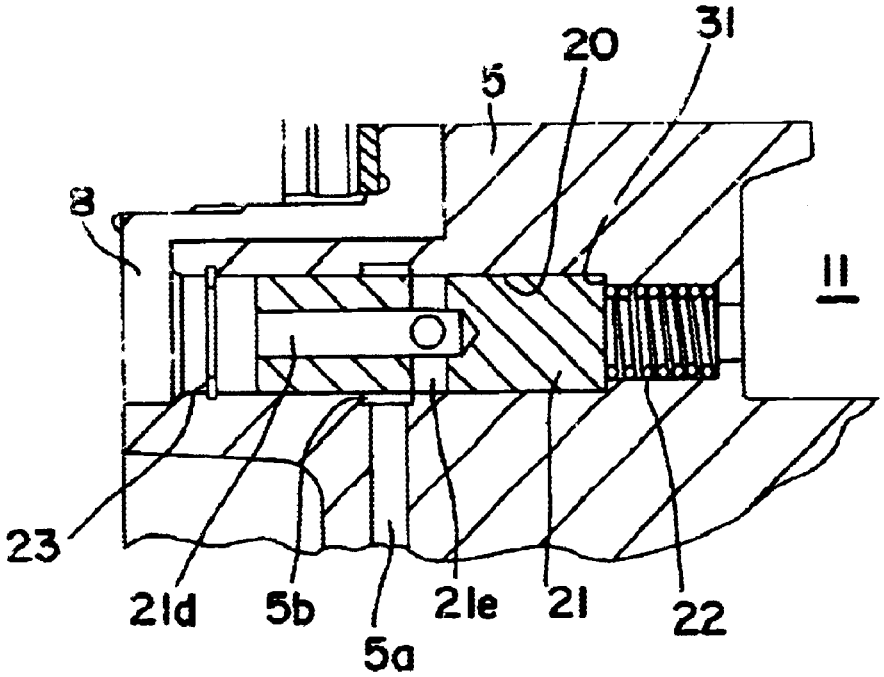

With reference to FIG. 1, and FIGS. 2(*a*) and 2(*b*), a cylinder bore 20 is formed in main housing 5 of the scroll-type compressor. The cylinder bore 20 extends from the medium pressure chamber 8 side of the main housing 5 to the low pressure chamber 11 side of the main housing 5, thereby connecting the medium pressure chamber 8 and the low pressure chamber 11.

An oil passage 5*a,* which is formed in a lower part of the main housing 5, places the second high pressure chamber 1*b* in fluid communication with the cylinder bore 20. Lubricating oil in the oil sump 18 may flow to the second high pressure chamber 1*b.* From there, the lubricating oil may flow to the medium pressure chamber 8, via the oil passage 5*a* and cylinder bore 20, due to the pressure difference between the second high pressure chamber 1*b* and the medium pressure chamber 8.

A piston valve 21 is disposed slidably in the cylinder bore 20. A spring 22, e.g., a compression spring, is accommodated in the cylinder bore 20 between the piston valve 21 and the low pressure chamber 11. The spring 22 engages the piston valve 21 and resiliently biases the piston valve 21 toward the medium pressure chamber 8. Moreover, a snap ring 23 is fused in the cylinder bore 20 between the piston valve 21 and the medium pressure chamber 8. The snap ring 23 retains the piston valve 21 within the cylinder bore 20 against the force of the spring 22 and the refrigerant in the low pressure chamber 11. Thus, the piston valve 21 moves in the cylinder bore 20, in response to a pressure differential that may exist between the refrigerant in the medium pressure chamber 8, and the refrigerant in the low pressure chamber 11, and the force of the spring 22.

A first pressure reception surface 21*a* is formed on an end of the piston valve 21 facing the medium pressure chamber 8. A second pressure reception surface 21*b* is formed on an end of the piston valve 21 facing the low pressure chamber 11. An axial hole 21*d* is formed along a portion of the axis of the piston valve 21 and extends through the first pressure reception area 21*a,* so that the axial hole 21*d* communicates with the medium pressure chamber 8. The axial hole 21*d* also communicates with a plurality of radial holes 21*e* formed in the piston valve 21. When the piston valve 21 is displaced so that one or more of the plurality of radial holes 2l*e* are aligned with the oil passage 5*a,* as shown in FIGS. 1 and 2(*a*), the axial hole 21*d* is in fluid communication with the oil passage 5*a.* A ringed groove 5*b* is formed on an inner surface of the cylinder bore 20 where the oil passage 5*a* intersects the cylinder bore 20. Thus, the position of the piston valve 21 within the cylinder bore 20 regulates the flow of lubricating oil from the second high pressure chamber 1*b* through the oil passage 5*a* to the medium pressure chamber 8.

The position of the piston valve 21 within the cylinder bore 20 is determined by the pressure difference between the refrigerant in the medium pressure chamber 8, which acts on the first pressure reception surface 21*a,* and the refrigerant in the low pressure chamber 11, which acts on the second pressure reception area 21*b,* and by the force of the spring 22. When the force of the refrigerant in the low pressure chamber 11 acting on second pressure reception area 21*b* and the force of the spring 22 exceed the force of the refrigerant in the medium pressure chamber 8 acting on the first pressure reception surface 21*a,* the piston valve 21 is displaced toward the medium pressure chamber 8. As the piston valve 21 is displaced toward the medium pressure chamber 8, one or more of the radial holes 21*e* may align with the oil passage 5*a,* as shown in FIG. 2(*a*), thereby placing the axial hole 21*d* and the medium pressure chamber 8 in fluid communication with the second high pressure chamber 1*b,* so that lubricating oil may be fed from the second high pressure chamber 1*b* to the medium pressure chamber 8 via the oil passage 5*a.* When the force exerted on the piston valve 21 by the refrigerant in the medium pressure chamber 8 exceeds the combined forces exerted on the piston valve 21 by the refrigerant in the low pressure chamber 11 and the spring 22, the piston valve 21 is displaced toward the low pressure chamber 11, as shown in FIG. 2(*b*), thereby reducing or stopping the flow of lubricating oil from the oil passage 5*a* to the axial hole 21*d* and the medium pressure chamber 8.

The lubricating oil that is supplied to the medium pressure chamber 8 via the oil passage 5*a,* the radial holes 21*e,* and the axial hole 21*d,* may be transported by the refrigerant in the medium pressure chamber 8 to the low pressure chamber 11 through the first radial bearing 9*a,* thereby lubricating the first and the second radial bearings 9*a,* 9*b.* As the pressure in the medium pressure chamber 8 decreases due to the flow of refrigerant from the medium pressure chamber 8 to the low pressure chamber 11, the force of the spring 22 and the refrigerant in the low pressure chamber 11 acting on the piston valve 21 eventually exceed the force of the refrigerant in the medium pressure chamber 8 acting on the piston valve 21, whereupon the piston valve 21 is displaced from a position adjacent to the low pressure chamber 11, as shown in FIG. 2(*b*), toward the medium pressure chamber 8, as shown in FIG. 2(*a*), thereby establishing fluid communication between the oil passage 5*a* and the medium pressure chamber 8, via the radial holes 21*e* and the axial hole 21*d.*

After the lubricating oil lubricates the first and second radial bearings 9*a* and 9*b,* the lubricating oil flows into the low pressure chamber 11, where it lubricates the sliding portions between the orbiting scroll 14 and the Oldham ring 13. The lubricating oil may be moved by the compressor, e.g., the orbiting scroll, the Oldham ring 13, so that the lubricating oil mixes with the refrigerant that is drawn into the compressor from the suction port 16. Thereafter, the lubricating oil flows through the compressor with the refrigerant until the lubricating oil is discharged from the compressor through the discharge hole 15*b,* whereupon the lubricating oil returns to the oil sump 18.

According to a first embodiment of the present invention, an inner diameter of the cylinder bore 20 adjacent to the spring 22 is reduced inwardly as a stepped, limiting portion 31 that engages an end surface of the piston valve 21 to limit further axial movement of the piston valve 21 toward the spring 22. When the piston valve 21 engages the limiting portion 31, as shown in FIG. 2(*b*), further compression of the spring 22 by the piston valve 21 is prevented, thereby protecting the spring 22 from being overcompressed by the piston valve 21. Thus, the inwardly stepped, limiting portion 31 of the cylinder bore 20 limits the movement of the piston valve 21 to prevent overcompression of the spring 22.

According to this arrangement, movement of the piston valve 21 against the spring 22 is limited by the limiting portion 31, so that the spring 22 is not overcompressed, e.g., compressed so that the coils of the spring are in contact. Thus, any damage to the spring 22, e.g., loss of elasticity, deformation, breakage, or the like, is effectively prevented or reduced.

Figure 3A:
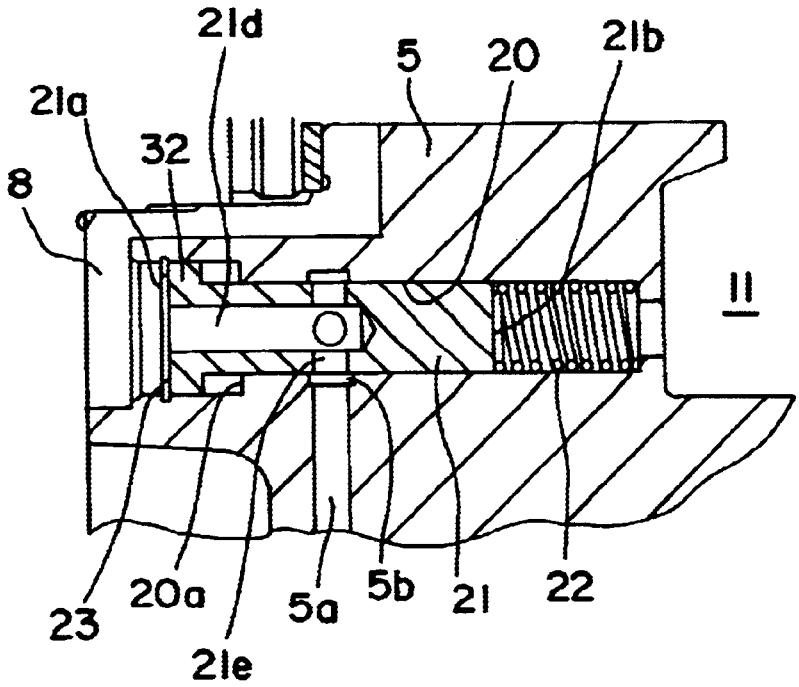
FIG. 3(*a*) and FIG. 3(*b*) show magnified cross-sectional views of a piston valve mechanism at different stages of compression, according to a second embodiment of the present invention.
Figure 3B:
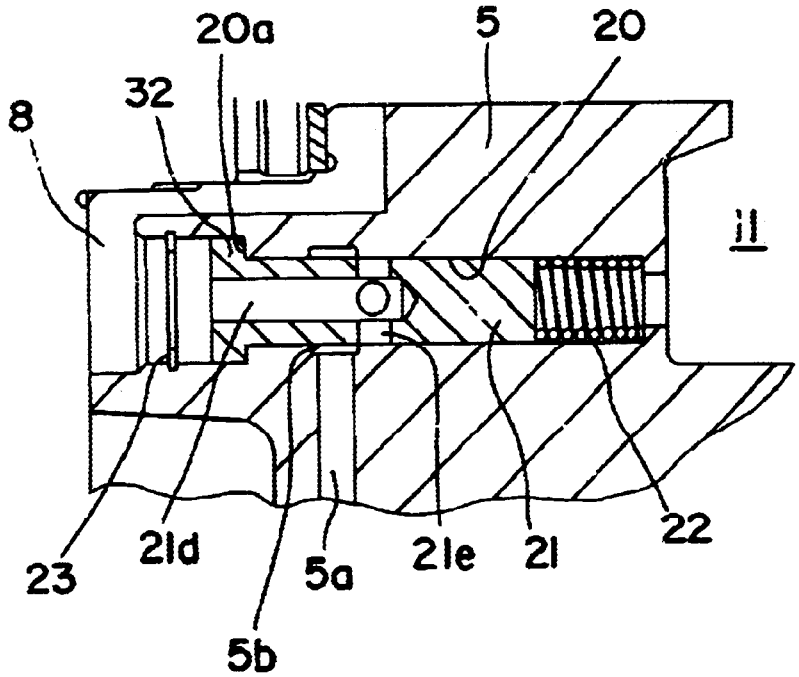

With reference to FIGS. 3(*a*) and 3(*b*), a second embodiment of the present invention is described. Parts that were disclosed and discussed in reference to the previous embodiment are given the same reference numerals and a further explanation of their structure and function is omitted here.

In the scroll-type compressor according to the second embodiment, an outwardly stepped flange 32 is formed on the piston valve 21, adjacent to the first pressure reception surface 21*a*. Moreover, an inner diameter of the cylinder bore 20 is increased by steps to form a shoulder 20*a* on the cylinder bore 20. When the flange 32 engages the shoulder 20*a,* as shown in FIG. 3(*b*), further movement of the piston valve 21 and compression of the spring 22 is prevented, thereby reducing or eliminating a tendency of the spring 22 to be overcompressed. Thus, the flange 32 functions as a stroke limiting mechanism for the piston valve 21.

According to this arrangement, movement of the piston valve 21 against the spring 22 is limited by the interaction of the flange 32 and the shoulder 20*a,* so that the spring 22 is not overcompressed, e.g., compressed so that the coils of the spring 22 are in contact. Thus, any damage to the spring 22, e.g., loss of elasticity, deformation, breakage, or the like, is effectively prevented or reduced.

Figure 4A:
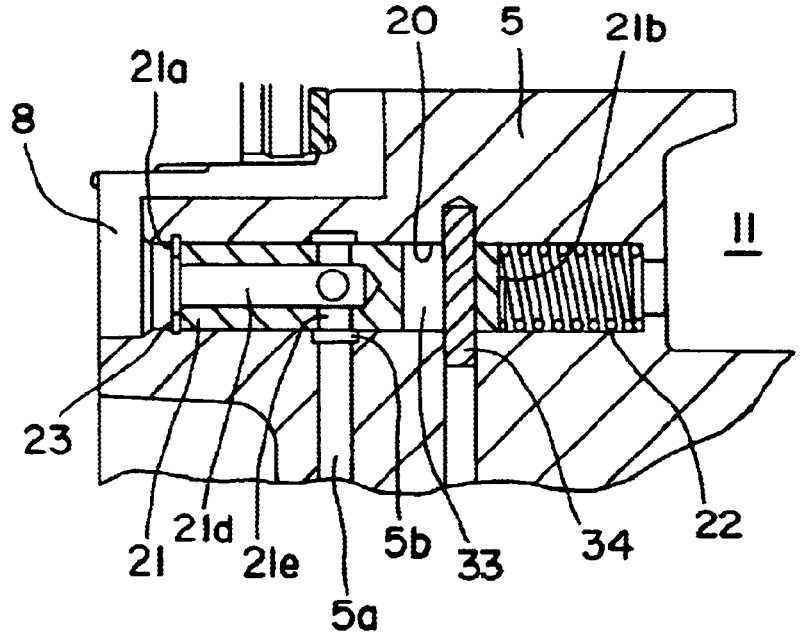
FIG. 4(*a*) and FIG. 4(*b*) show magnified cross-sectional views of a piston valve mechanism at different stages of compression, according to a third embodiment of the present invention.
Figure 4B:
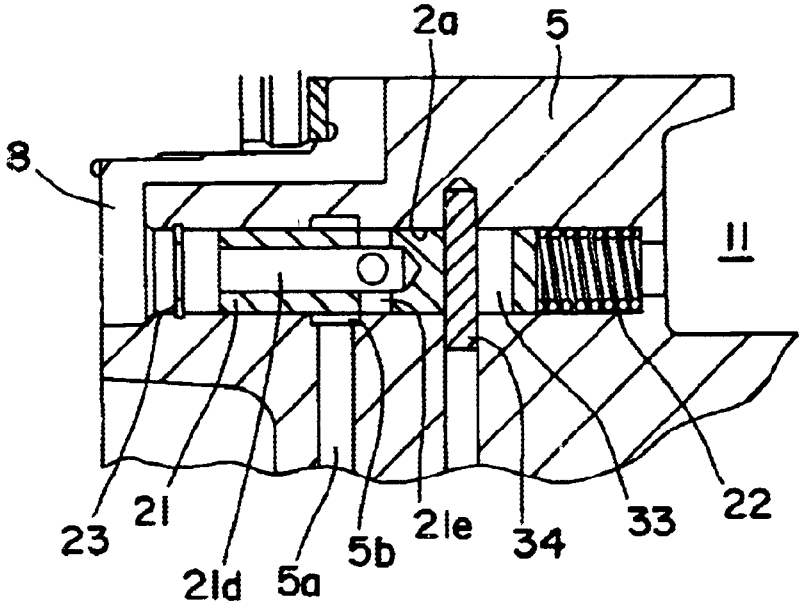

With reference to FIGS. 4(*a*) and 4(*b*), a third embodiment of the present invention is described. Parts that were disclosed and discussed in reference to the previous embodiments are given the same reference numerals and a further explanation of their structure and function is omitted here.

In the scroll-type compressor according to the third embodiment, a penetrating hole 33 is bored in the piston valve 21, in addition to the radial holes 21*e*. The penetrating hole 33 extends through the piston valve 21 in a direction that is substantially transverse to a longitudinal axis of the piston valve 21. A pin 34, which is fixed to the main housing 5, extends through the penetrating hole 33. The penetrating hole 33 has an oblong shape that extends in a longitudinal, axial direction of the piston valve 21 and that enables the piston valve 21 to move within the cylinder bore 20 relative to the pin 34. The engagement of the pin 34 and an inner wall surface of the penetrating hole 33 limits the displacement of the piston valve 21 within the cylinder bore 20, as shown in FIGS. 4(*a*) and 4(*b*). Moreover, overcompression of the spring 22 is prevented by the engagement of the pin 34 and the inner wall surface of the penetrating hole 33 closest to the axial hole 21*d,* as shown in FIG. 4(*b*). Thus, the pin 34 and the penetrating hole 33 function as a stroke limiting mechanism for the piston valve 21.

According to this arrangement, movement of the piston valve 21 against the spring 22 is limited by the interaction of the pin 34 and an inner wall of the penetrating hole 33, so that the spring 22 is not overcompressed, e.g., compressed, so that the coils of the spring 22 are in contact. Thus, any damage to the spring 22, e.g., loss of elasticity, deformation, breakage, or the like, is effectively prevented or reduced.

Figure 5A:
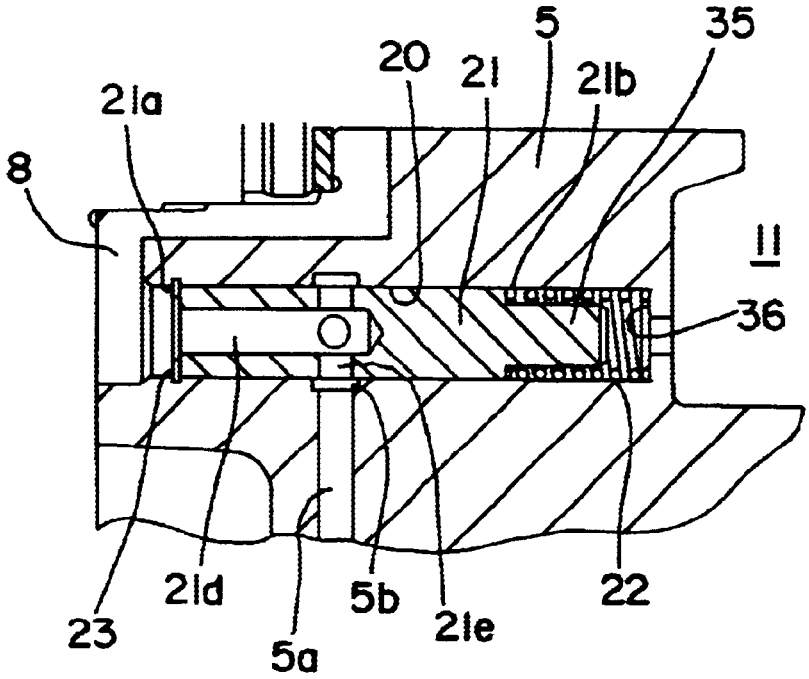
FIG. 5(*a*) and FIG. 5(*b*) show magnified cross-sectional views of a piston valve mechanism at different stages of compression, according to a fourth embodiment of the present invention.
Figure 5B:
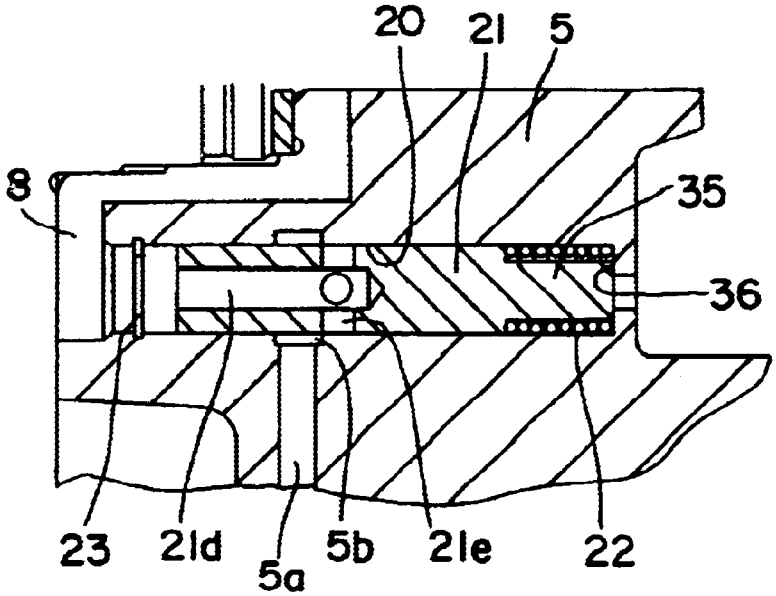

With reference to FIGS. 5(*a*) and 5(*b*), a fourth embodiment of the present invention is described. Parts that were disclosed and discussed in reference to the previous embodiments are given the same reference numerals and a further explanation of their structure and function is omitted here.

In the scroll-type compressor according to the fourth embodiment, a rod 35 extends from an end of the piston valve, so as to penetrate into the coils of the spring 22. A stopping portion 36 is formed on the main housing 5 at an end of the cylinder bore 20 adjacent to the low pressure chamber 11. When the rod 35 engages the stopping portion 36, further movement of the piston valve 21 against the spring 22 is prevented, as shown in FIG. 5(*b*), thereby reducing or eliminating a tendency of the spring 22 to be overcompressed. Thus, the rod 35 and the stopping portion 36 function as a stroke limiting mechanism for the piston valve 21.

According to this arrangement, movement of the piston valve 21 against the spring 22 is limited by the interaction of the rod 35 and the stopping portion 36, so that the spring 22 is not overcompressed, e.g., compressed so that the coils of the spring 22 are in contact. Thus, any damage to the spring 22, e.g., loss of elasticity, deformation, breakage, or the like, is effectively prevented or reduced.

Figure 6A:
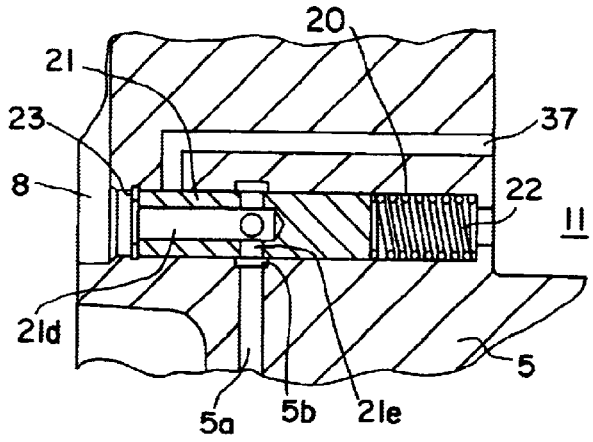
FIG. 6(*a*), FIG. 6(*b*), and FIG. 6(*c*) show magnified cross-sectional views of a piston valve mechanism at different stages of compression, according to a fifth embodiment of the present invention.
Figure 6B:
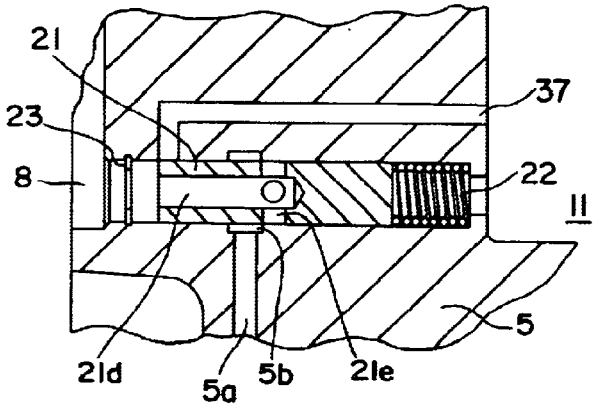
Figure 6C:
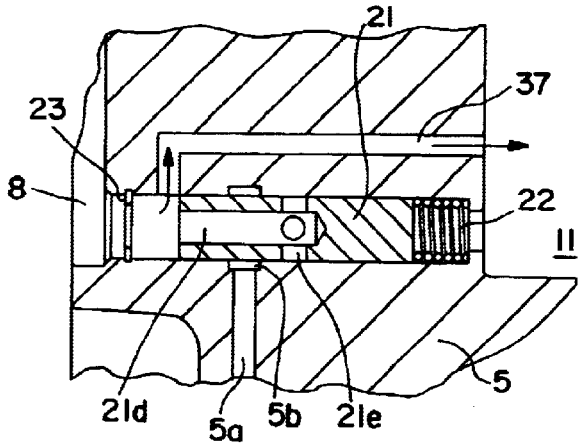

With reference to FIGS. 6(*a*), 6(*b*), and 6(*c*), a fifth embodiment of the present invention is described. Parts that were disclosed and discussed in reference to the previous embodiments are given the same reference numerals and a further explanation of their structure and function is omitted here.

In the scroll-type compressor according to the fifth embodiment, a relief passage 37 is formed in the main housing 5. One end of the relief passage 37 communicates with the medium pressure chamber 8 via the cylinder bore 20, while another end of the relief passage 37 communicates with the low pressure chamber 11. When the piston valve 21 is displaced fully toward the medium pressure chamber 8, e.g., when the piston valve contacts the snap ring 23, as shown in FIG. 6(*a*), the piston valve closes the relief passage 37, thereby preventing fluid communication between the medium pressure chamber 8 and the low pressure chamber 11. Moreover, the piston valve 21 continues to close the relief passage 37, as shown in FIG. 6(*b*), even as the piston valve 21 is displaced initially from the snap ring 23. However, when the piston valve 21 is displaced in the direction of the low pressure chamber 11 beyond the opening of the relief passage 37, as shown in FIG. 6(*c*), the relief passage 37 may establish fluid communication between the low pressure chamber 11 and the medium pressure chamber 8 to allow refrigerant from the medium pressure chamber 8 to flow to the low pressure chamber 11 via the relief passage 37. The flow of refrigerant from the medium pressure chamber 8 to the low pressure chamber 11 reduces the pressure differential between those pressure chambers, so that further movement of the piston valve 21 against the spring 22 is limited and overcompression of the spring 22 is effectively prevented. Thus, the interaction of the relief passage 37 and the piston valve 21 functions as a stroke limiting mechanism for the piston valve 21.

According to this arrangement, movement of the piston valve 21 against the spring 22 is limited by movement of the piston valve 21 to open the relief passage 37 to provide fluid communication between the medium pressure chamber 8 and the low pressure chamber 11, so that the spring 22 is not overcompressed, e.g., compressed so that the coils of the spring are in contact. Thus, any damage to the spring 22, e.g., loss of elasticity, deformation, breakage, or the like, is effectively prevented or reduced.

Figure 7A:
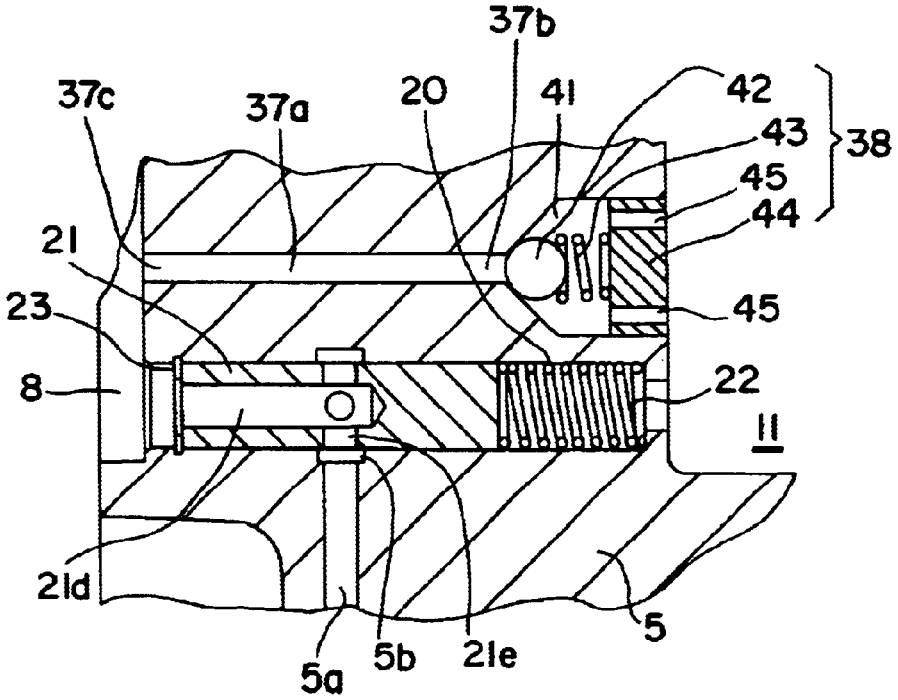
FIG. 7(*a*) and FIG. 7(*b*) show magnified cross-sectional views of a piston valve mechanism at different stages of compression, according to a sixth embodiment of the present invention.
Figure 7B:
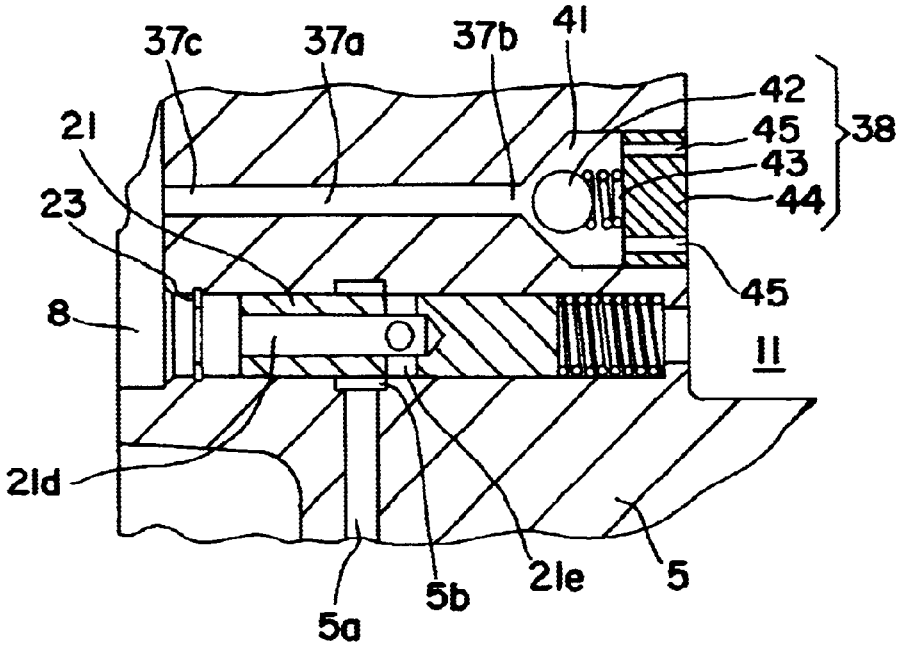

With reference to FIGS. 7(*a*) and 7(*b*), a sixth embodiment of the present invention is described. Parts that were disclosed and discussed in reference to the previous embodiments are given the same reference numerals and a further explanation of their structure and function is omitted here.

In the scroll-type compressor according to the sixth embodiment, a relief passage 37*a* is formed in the housing 5. The relief passage 37*a* has an opening 37*c* that communicates directly with the medium pressure chamber 8, as shown in FIGS. 7(*a*) and 7(*b*), instead of communicating indirectly via the cylinder bore 20, as in the previous embodiment shown in FIGS. 6(*a*)–6(*c*). Moreover, the relief passage 37*a* has another opening 37*b* that communicates with a valve chamber 41 of a relief valve 38.

The relief valve 38 comprises a valve body 42 disposed in the valve chamber 41, a spring 43 which energizes the valve body 42 toward the opening 37*b,* and a spring support 44 that is fixed to the main housing 5 and that supports the spring 43. A plurality of holes 45 are formed through the spring support 44, thereby placing the valve chamber 41 in fluid communication with the low pressure chamber 11.

When the pressure differential between the medium pressure chamber 8 and the low pressure chamber 11 is slight, the force of the refrigerant in the medium pressure chamber 8 acting on the valve body 42 is insufficient overcome the combined forces of the spring 43 and the refrigerant in the low pressure chamber 11 acting on the valve body 42, the relief valve 38 is closed, as shown in FIG. 7(*a*). When the pressure differential between the medium pressure chamber 8 and the low pressure chamber 11 increases enough so that the force of the refrigerant in the medium pressure chamber 8 acting on the valve body 42 overcomes the combined forces of the spring 43 and the refrigerant in the low pressure chamber 11 acting on the valve body 42, the relief valve 38 opens the relief passage 37*a,* as shown in FIG. 7(*b*), before the piston valve 21 overcompresses the spring 22. Thus, when the pressure differential between the medium pressure chamber 8 and the low pressure chamber 11 increases beyond a desired level, the relief valve 38 opens the relief passage 37*a,* so that pressurized fluid in the medium pressure chamber 8 flows to the low pressure chamber 11 via the relief passage 37*a,* thereby reducing the pressure differential that is displacing the piston valve 21 against the spring 22. Thus, when the relief passage 37*a* is opened, further movement of the piston valve 21 against the spring 22 is limited before the spring 22 is overcompressed. Thus, the relief passage 37*a* and the relief valve 38 function as a stroke limiting mechanism for the piston valve 21.

According to this arrangement, movement of the piston valve 21 against the spring 22 is limited by the relief valve 38 opening the relief passage 37*a* to provide fluid communication between the medium pressure chamber 8 and the low pressure chamber 11, so that the spring 22 is not overcompressed, e.g., compressed so that the coils of the spring are in contact. Thus, any damage to the spring 22, e.g., loss of elasticity, deformation, breakage, or the like, is effectively prevented or reduced.

Although the present invention has been described in connection with preferred embodiments, the invention is not limited thereto. It is intended that the specification and embodiments disclosed therein be considered as exemplary only, with the true scope and spirit of the invention being indicated by the following claims. It will be understood by those skilled in the art that other embodiments, variations, and modifications will be apparent to those skilled in the art from a consideration of this specification or a practice of the invention disclosed herein, and may be made within the scope of this invention, as defined by the following claims.

What is claimed is:

1. A scroll-type compressor comprising a piston valve mechanism for controlling a flow of lubricating oil within said compressor comprises:

a cylinder bore for establishing fluid communication between a medium pressure chamber and a low pressure chamber; and a piston valve and a spring accommodated within said cylinder bore, wherein said piston valve is driven by a pressure difference between said medium pressure chamber and said low pressure chamber, and by said spring that biases said piston valve toward said medium pressure chamber, and wherein a stroke limiting mechanism limits movement of said piston valve against said spring.

2. The scroll-type compressor of claim 1, wherein, said stroke limiting mechanism comprises an inwardly stepped, limiting portion of said cylinder bore for engaging an end surface of said piston valve.

3. The scroll-type compressor of claim 1, wherein, said stroke limiting mechanism comprises an outwardly stepped flange formed on said piston valve for engaging a shoulder formed in said cylinder bore.

4. The scroll-type compressor of claim 1, wherein, said stroke limiting mechanism comprises a penetrating hole bored through said piston valve, a pin extending from a compressor housing through said penetrating hole, wherein movement of said piston valve is limited by engagement of said pin and an inner wall of said penetrating hole.

5. The scroll-type compressor of claim 1, wherein, said stroke limiting mechanism comprises a rod formed on one end of said piston valve and inserted into said spring, wherein movement of said piston valve is limited by engagement of said rod and a stopping portion formed at an end of said cylinder bore.

6. The scroll-type compressor of claim 1, wherein, said stroke limiting mechanism comprises a relief passage for providing fluid communication between said medium pressure chamber and said low pressure chamber, wherein said piston valve opens said relief passage to reduce a pressure differential between said medium pressure chamber and said low pressure chamber to limit further movement of said piston valve against said spring.

7. The scroll-type compressor of claim 1, wherein, said stroke limiting mechanism comprises a relief passage for providing fluid communication between said medium pressure chamber and said low pressure chamber and a valve mechanism that opens said relief passage when a pressure differential between said medium pressure chamber and said low pressure chamber exceeds a desired level to limit further movement of said piston valve against said spring.

* * * * *